US008870366B2

(12) United States Patent
Akatsu et al.

(10) Patent No.: US 8,870,366 B2
(45) Date of Patent: Oct. 28, 2014

(54) MEDIUM LOADING APPARATUS AND RECORDING APPARATUS

(71) Applicant: Seiko Epson Corporation, Tokyo (JP)

(72) Inventors: Shoji Akatsu, Shiojiri (JP); Akira Mashima, Azumino (JP); Tomoya Murotani, Matsumoto (JP); Yoshitaka Shimada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 44 days.

(21) Appl. No.: 13/793,528

(22) Filed: Mar. 11, 2013

(65) Prior Publication Data

US 2013/0278696 A1 Oct. 24, 2013

(30) Foreign Application Priority Data

Apr. 23, 2012 (JP) ..... 2012-097417

(51) Int. Cl.

| | |
|---|---|
| ***B41J 2/01*** | (2006.01) |
| ***B65H 16/02*** | (2006.01) |
| ***B65H 16/10*** | (2006.01) |
| ***B41J 11/00*** | (2006.01) |
| ***B41J 15/04*** | (2006.01) |

(52) U.S. Cl.

CPC ..... *B41J 11/00* (2013.01); *B65H 16/02* (2013.01); *B65H 16/103* (2013.01); *B41J 11/001* (2013.01); *B41J 15/042* (2013.01)

USPC ..... 347/104

(58) Field of Classification Search

CPC ..... B41J 11/14; B41J 11/20; B41J 15/04; B41J 15/042

See application file for complete search history.

(56) References Cited

U.S. PATENT DOCUMENTS

| | | | | |
|---|---|---|---|---|
| 6,109,804 | A * | 8/2000 | Higashi et al. | 400/611 |
| 2008/0277851 | A1* | 11/2008 | Genta | 269/56 |
| 2009/0212152 | A1 | 8/2009 | Ozaki et al. | |
| 2009/0242603 | A1* | 10/2009 | Kobayashi et al. | 226/179 |

FOREIGN PATENT DOCUMENTS

| | | | |
|---|---|---|---|
| JP | 58-148785 | A | 9/1983 |
| JP | 59-218879 | A | 12/1984 |
| JP | 62-249845 | A | 10/1987 |
| JP | 05-051653 | U | 7/1993 |
| JP | 2009-226920 | A | 10/2009 |

* cited by examiner

*Primary Examiner* — Shelby Fidler
*Assistant Examiner* — Tracey McMillion
(74) *Attorney, Agent, or Firm* — Nutter McClennen & Fish LLP; John J. Penny, V.

(57) ABSTRACT

A medium loading apparatus includes supporting units that are attached to both end portions of roll paper, a loading unit that is loaded with the roll paper to which the supporting units are attached, and a rotational force transfer unit that is arranged on the loading unit so as to be opposed to a shaft rotating member constituting the supporting unit in the axial line direction of the roll paper and transfers a rotational force of a motor to the shaft rotating member.

6 Claims, 18 Drawing Sheets

MEDIUM LOADING APPARATUS AND RECORDING APPARATUS

BACKGROUND

1. Technical Field

The present invention relates to a recording apparatus such as an ink jet printer and a medium loading apparatus included in the recording apparatus.

2. Related Art

In general, an ink jet printer has been widely known as a type of a recording apparatus. The printer supplies ink to a recording head and ejects the supplied ink onto a recording medium through nozzles of the recording head so as to perform printing. Among such printers, there is a printer that uses roll paper having a large size as a recording medium (for example, JP-A-2009-226920).

In the printer as disclosed in JP-A-2009-226920, a roll paper supply unit includes a movable holder, a fixed holder, and a guide rail arranged between both the holders. When a user performs a set operation of a roll body (roll paper) onto the roll paper supply unit, the roll body in which a fixed flange and a movable flange are fitted to both ends is placed on the guide rail along the guide rail.

Thereafter, if the movable holder is moved to the side of the fixed holder along the guide rail in a sliding manner, a driving shaft of the fixed holder and a driven shaft of the movable holder are inserted into a shaft hole of the fixed flange and a shaft hole of the movable flange on the roll body, respectively. With this, the set operation of the roll paper is completed.

In the printer as disclosed in JP-A-2009-226920, the driving shaft of the fixed holder and the driven shaft of the movable holder project to the inner side of the roll body in the axial line direction all the time. Therefore, in order to place the roll body between the movable holder and the fixed holder, the length of the roll paper supply unit needs to be made larger than at least a sum of the length of the roll body, the length of the driving shaft of the fixed holder, and the length of the driven shaft of the movable holder. Accordingly, there arises a problem that the roll paper supply unit is increased in size, and eventually, the printer is increased in size.

It is to be noted that there is the same problem on recording apparatuses having a configuration in which roll paper is supported by shafts in addition to the above-mentioned ink jet printer.

SUMMARY

An advantage of some aspects of the invention has been achieved by focusing on the above-mentioned problem present on the existing techniques and is to provide a medium loading apparatus and a recording apparatus that can be reduced in size.

A medium loading apparatus according to an aspect of the invention includes supporting units that have medium holding portions which are attached to both end portions of a roll medium obtained by winding and overlapping a long medium in a roll form in a rotatable manner with the roll medium and medium supporting portions which support the medium holding portions in a rotatable manner, a loading unit that is loaded with the roll medium to which the supporting units are attached, and a rotational force transfer unit that is arranged on the loading unit so as to be opposed to the medium holding portion in the axial line direction of the roll medium and transfers a rotational force of a rotation driving unit to the medium holding portion. In the medium loading apparatus, the rotational force transfer unit includes a first shaft member to which the rotational force of the rotation driving unit is transferred, a rotating member that is supported by the first shaft member in an integrally rotatable manner in a state where a rotational axial line is variable, and a second shaft member that is supported by the rotating member in an integrally rotatable manner and is configured to be movable between a transfer position at which the second shaft member is engaged with the medium holding portion and transfers the rotational force and a non-transfer position at which the second shaft member is distanced from the medium holding portion and does not transfer the rotational force.

According to the aspect of the invention, the roll medium is loaded on the loading unit in a state of being supported by the supporting units at both sides and the second shaft member is supported by the rotating member so as to be movable between the transfer position and the non-transfer position. Therefore, the second shaft member is moved to the non-transfer position before the roll medium is loaded on the loading unit and the second shaft member is moved to the transfer position after the roll medium has been loaded on the loading unit, so that the length of the loading unit can be made smaller than that in a configuration in which the roll medium is supported by inserting shafts thereinto from both sides. This makes it possible to reduce the apparatus in size.

In the medium loading apparatus according to the aspect of the invention, it is preferable that the second shaft member be engaged with the medium holding portion in a state where a rotational axial line is variable when the second shaft member is located at the transfer position.

According to the aspect of the invention, the second shaft member is engaged with the medium holding portion in a state where the rotational axial line of the second shaft member is variable. Therefore, even when the positions of the medium holding portion and the second shaft member are deviated in the radial direction, the deviation can be absorbed.

In the medium loading apparatus according to the aspect of the invention, it is preferable that the second shaft member be supported by the rotating member in a state of being restricted from moving in the radial direction and being movable between the transfer position and the non-transfer position in the axial line direction.

According to the aspect of the invention, deviation of the second shaft member with respect to the rotating member in the radial direction is eliminated, thereby suppressing the positional deviation of the second shaft member with respect to the medium holding portion in the radial direction.

A recording apparatus according to another aspect of the invention includes the medium loading apparatus having the above-mentioned configuration and a recording unit that performs recording processing on the roll medium to be fed from the medium loading apparatus.

According to the aspect of the invention, the same action effects that are the same as those obtained by the above-mentioned medium loading apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment in which a recording apparatus according to the invention is embodied to an ink jet printer is described with reference to the drawings.

Figure 1:
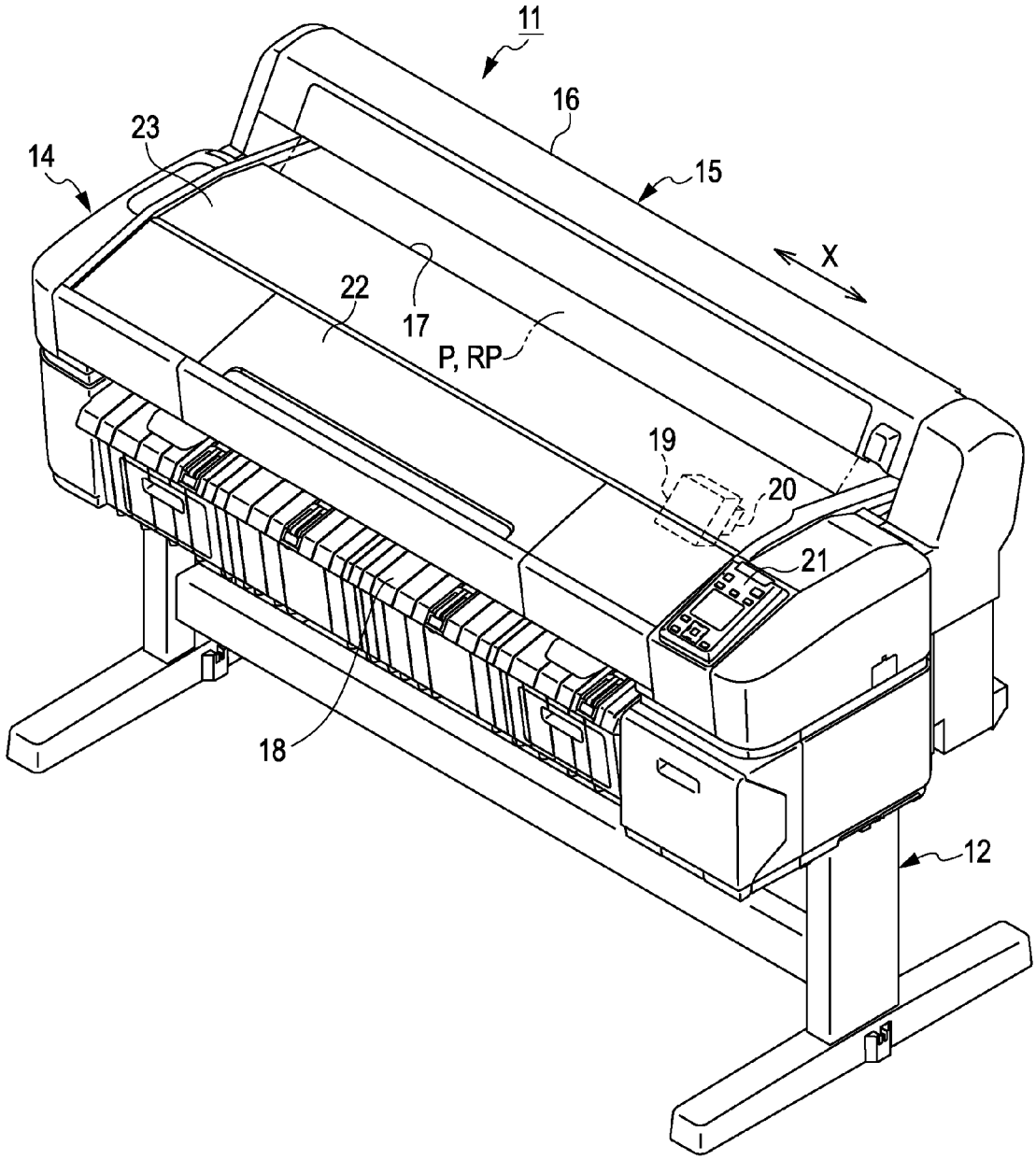
FIG. 1 is a perspective view illustrating an ink jet printer according to an embodiment.

As illustrated in FIG. 1, an ink jet printer 11 as a recording apparatus is supported on a leg base 12. The ink jet printer 11 includes a main body 14 having a substantially rectangular parallelepiped shape and a loading unit 15. The loading unit 15 is provided so as to project from a rear surface portion of the main body 14 to the upper rear side obliquely and roll paper RP as a roll medium obtained by winding and overlapping paper P as a long medium in a roll form is loaded on the loading unit 15.

An opening/closing cover 16 as a cover member is provided on an upper end portion of the loading unit 15 so as to be freely opened and closed. A paper feeding port 17 for feeding the paper P into the main body 14 is formed on a lower end portion of the loading unit 15 at a boundary position between the loading unit 15 and the main body 14. The paper P is fed out while being unrolled from the roll paper RP loaded on the loading unit 15. A transportation mechanism (not illustrated) is provided in the main body 14. The transportation mechanism transports the paper P fed from the paper feeding port 17 to a paper discharge port 18 formed on a front surface portion of the main body 14 along a transportation path of the paper P.

A carriage 19 is provided in the main body 14 at a position opposed to the transportation path of the paper P. The carriage 19 is provided so as to reciprocate in the width direction of the paper P that is orthogonal to the transportation direction thereof. A recording head 20 as a recording unit is supported on the carriage 19 at a position opposed to the transportation path of the paper P. The recording head 20 as the recording unit ejects ink through nozzles (not illustrated) onto the paper P to be transported on the transportation path while reciprocating in the scanning direction X orthogonal to the transportation direction of the paper P together with the carriage 19 so as to perform printing as recording processing.

The scanning direction X is set to the direction that is the same as the axial line direction of the roll paper RP (width direction of the roll paper RP) and the lengthwise direction of the main body 14. It is to be noted that an operation panel 21 is provided on an upper right end portion of the main body 14, for example. A user performs various setting operations and an input operation of various pieces of information on the operation panel 21.

A maintenance cover 22 is provided on a center portion of an upper portion of the main body 14 in the scanning direction X at the front surface side so as to be freely opened and closed. The maintenance cover 22 is opened for performing maintenance on the inner portion of the main body 14. On the other hand, a top plate 23 having a rectangular shape is provided on an upper end portion of the main body 14 so as to occupy the half thereof at the side of the loading unit 15 (rear surface side opposite to the front surface side).

Figure 2:
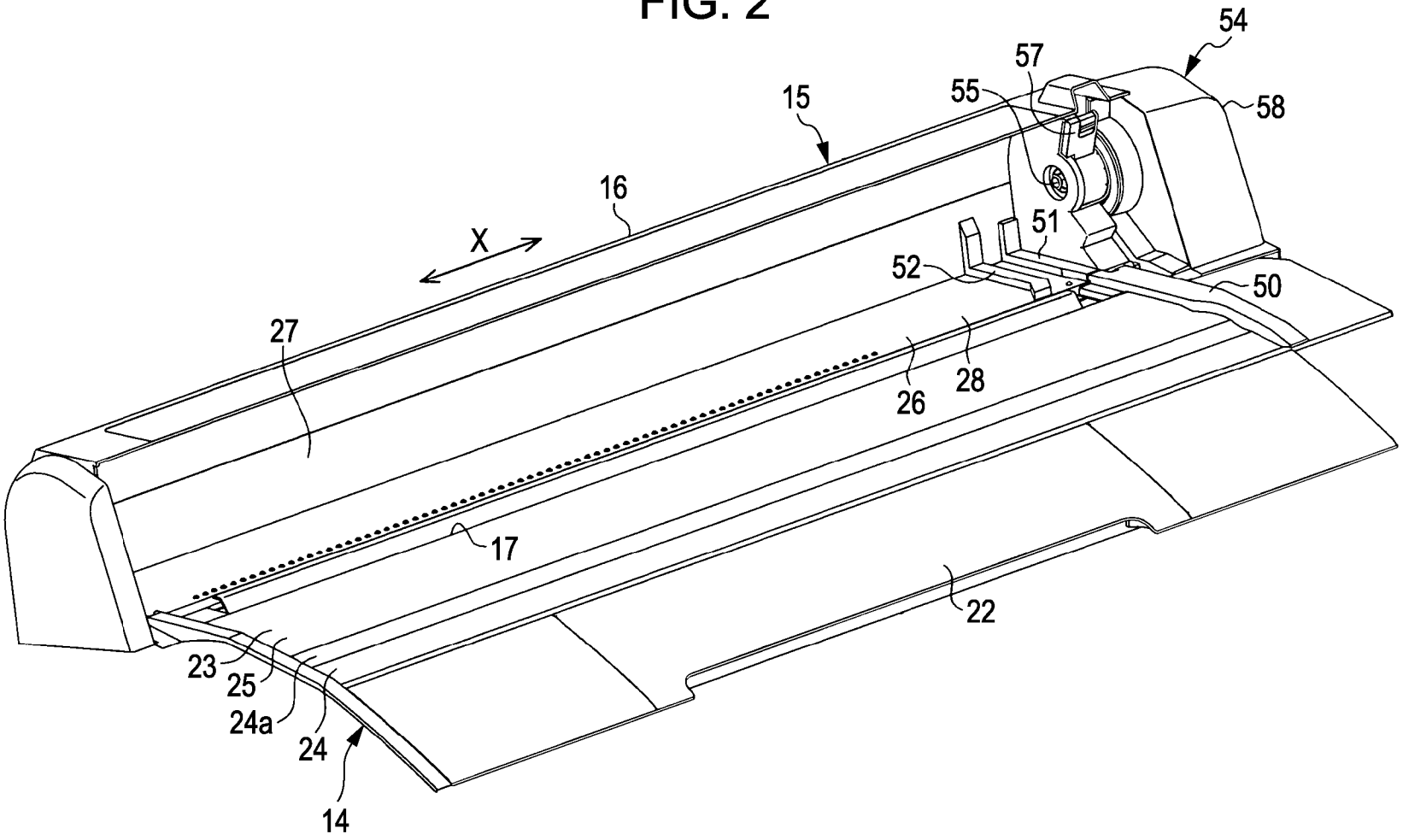
FIG. 2 is a perspective view illustrating a loading unit of the printer.

As illustrated in FIG. 2, the top plate 23 includes a horizontal temporal placement portion 24 and an inclined portion 25. The roll paper RP (see FIG. 16) is temporarily placed on the temporal placement portion 24 before being loaded on the loading unit 15. The inclined portion 25 is inclined downward from the temporal placement portion 24 toward the loading unit 15. A positioning concave portion **24*a* is formed on the temporal placement portion 24 so as to extend in the scanning direction X. The positioning concave portion 24*a* is a concave portion for suppressing rolling of the roll paper RP and positioning it when the roll paper RP (see FIG. 16**) is temporarily placed.

A bottom plate 26 having a rectangular shape that is parallel with the inclined portion 25 is provided on a lower end portion of the loading unit 15. In this case, the paper feeding port 17 is located between the bottom plate 26 and the inclined portion 25. A rear-side plate 27 having a rectangular shape is erected on an end portion of the bottom plate 26 at the side opposite to the side of the paper feeding port 17 so as to be perpendicular to the bottom plate 26. A region on the bottom plate 26 is set to a placement portion 28 on which the roll paper RP is placed when the roll paper RP (see FIG. 17) is loaded on the loading unit 15. Accordingly, the placement portion 28 is located at a position lower than the temporal placement portion 24.

Figure 3:
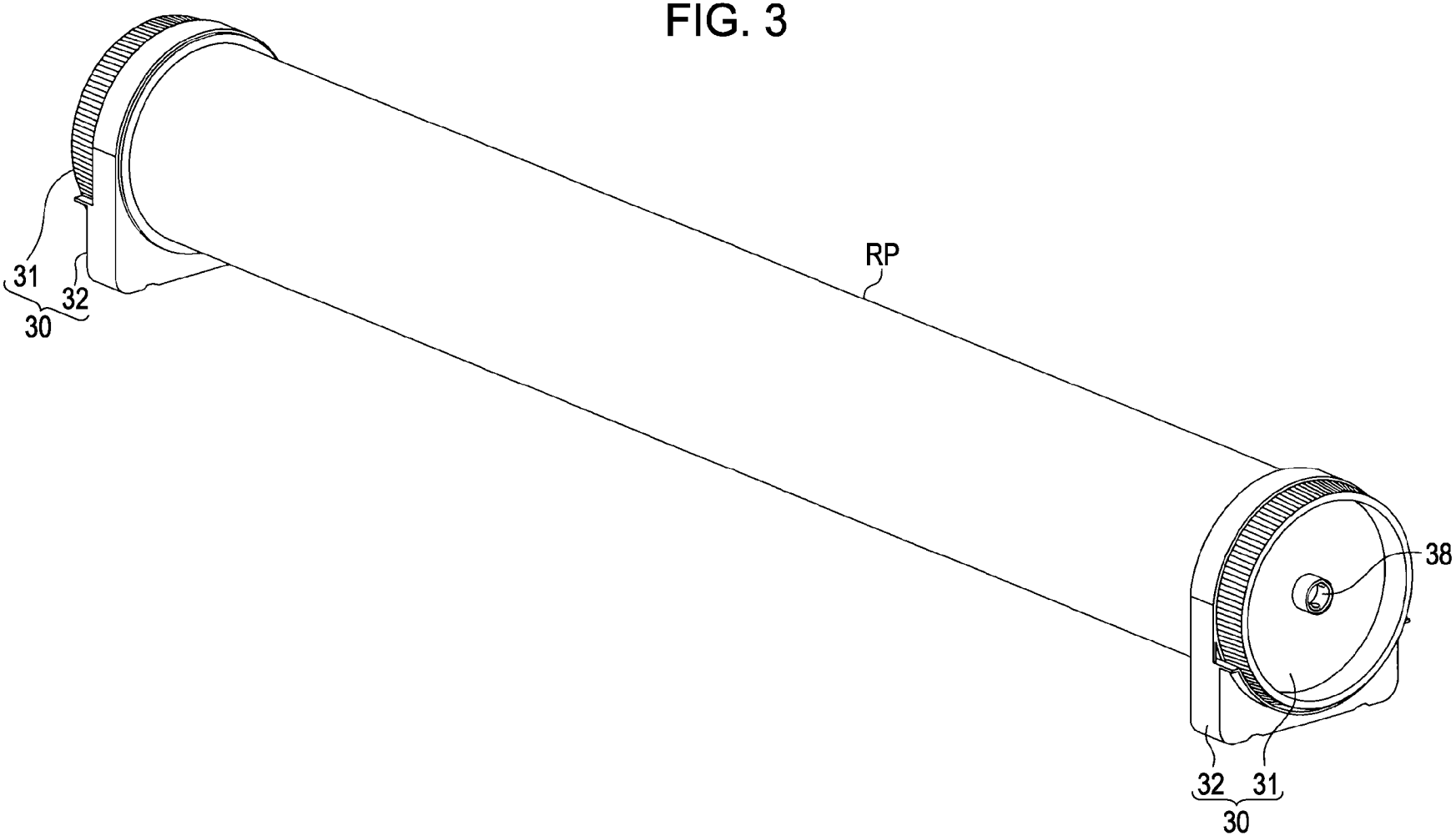
FIG. 3 is a perspective view illustrating roll paper to which supporting units are attached.

As illustrated in FIG. 2 and FIG. 3, when the roll paper RP is loaded on the loading unit 15, supporting units 30 that support the roll paper RP in a rotatable manner are attached to both end portions of the roll paper RP. That is to say, each supporting unit 30 includes a shaft rotating member 31 as a medium holding portion and a flange member 32 as a medium supporting portion. The shaft rotating member 31 holds the roll paper RP in an integrally rotatable manner. The flange member 32 supports the shaft rotating member 31 in a rotatable manner.

Figure 4:
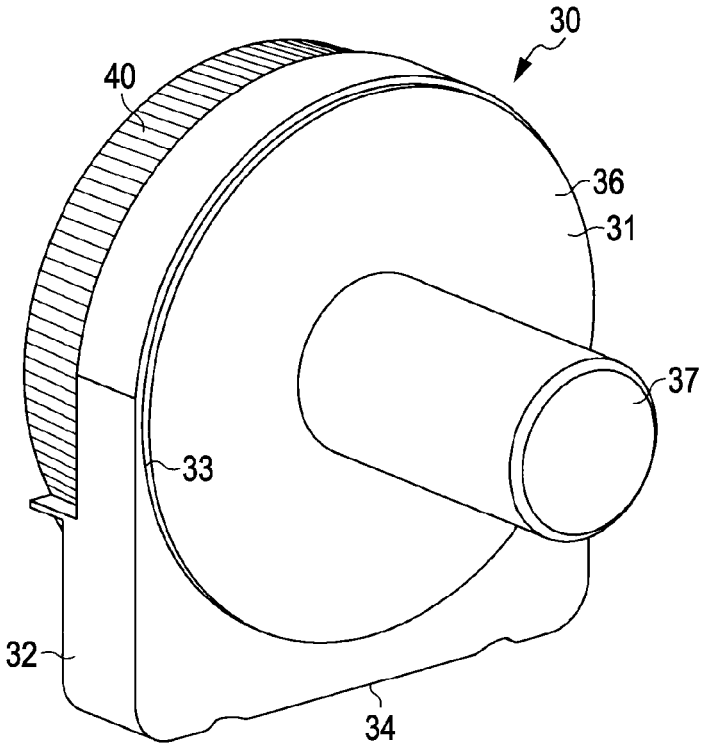
FIG. 4 is a perspective view illustrating the supporting unit.
Figure 5:
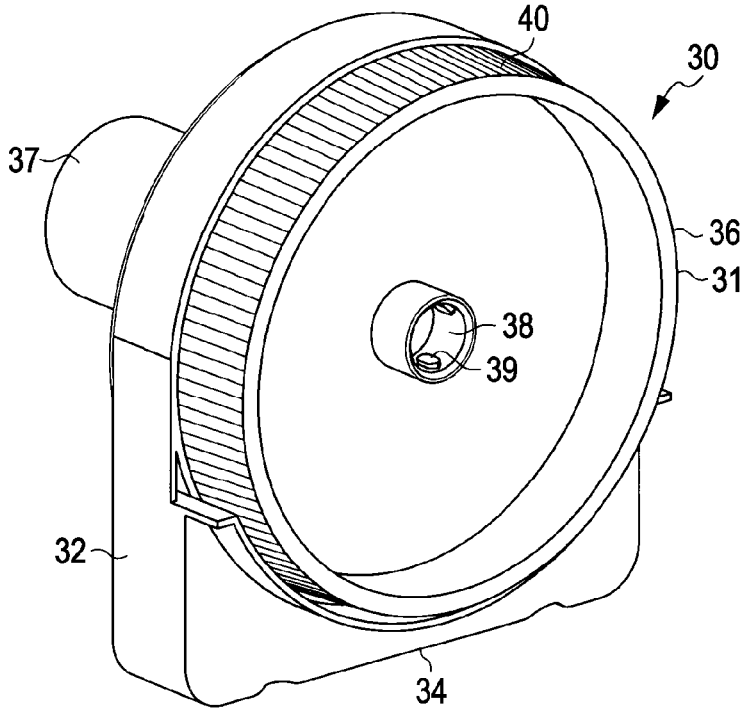
FIG. 5 is a perspective view illustrating the supporting unit.

As illustrated in FIG. 4 and FIG. 5, the flange member 32 of the supporting unit 30 is formed such that the upper half has a semicircular shape and the lower half has a substantially rectangular shape. That is to say, the flange member 32 is formed into a substantially D-shaped form as a whole. A circular supporting hole 33 is formed on the flange member 32 along the outer edge of the semicircular shape portion so as to penetrate through the flange member 32. The lower surface of the flange member 32 is formed as a flattened surface 34 having a substantially rectangular shape.

The shaft rotating member 31 includes a substantially circular plate-like rotating portion 36, a columnar shaft portion 37, and a circular shaft hole 38. The shaft portion 37 is provided at the center portion of the side surface of the rotating portion 36 at one side in a projecting manner and is fitted into a center hole H (see FIG. 16) of the roll paper RP. The shaft hole 38 is formed on the center portion of the side surface (surface at the side opposite to the side of the shaft portion 37) of the rotating portion 36 at the other side. A plurality of engaging pieces 39 are formed on the inner circumferential surface of the shaft hole 38 at a constant interval in the circumferential direction.

The outer diameter of the rotating portion 36 is set to be slightly larger than the outer diameter of the roll paper RP having a maximum diameter. The half of the rotating portion 36 at the shaft portion 37 side is inserted into the supporting hole 33 of the flange member 32 in a rotatable manner and the half of the rotating portion 36 at the side opposite to the shaft portion 37 is exposed. A number of ribs 40 functioning as slip-proof portions when a user rotates the shaft rotating member 31 manually are formed on the circumferential surface of the rotating portion 36 that is exposed from the supporting hole 33 at a constant interval in the circumferential direction.

Figure 6:
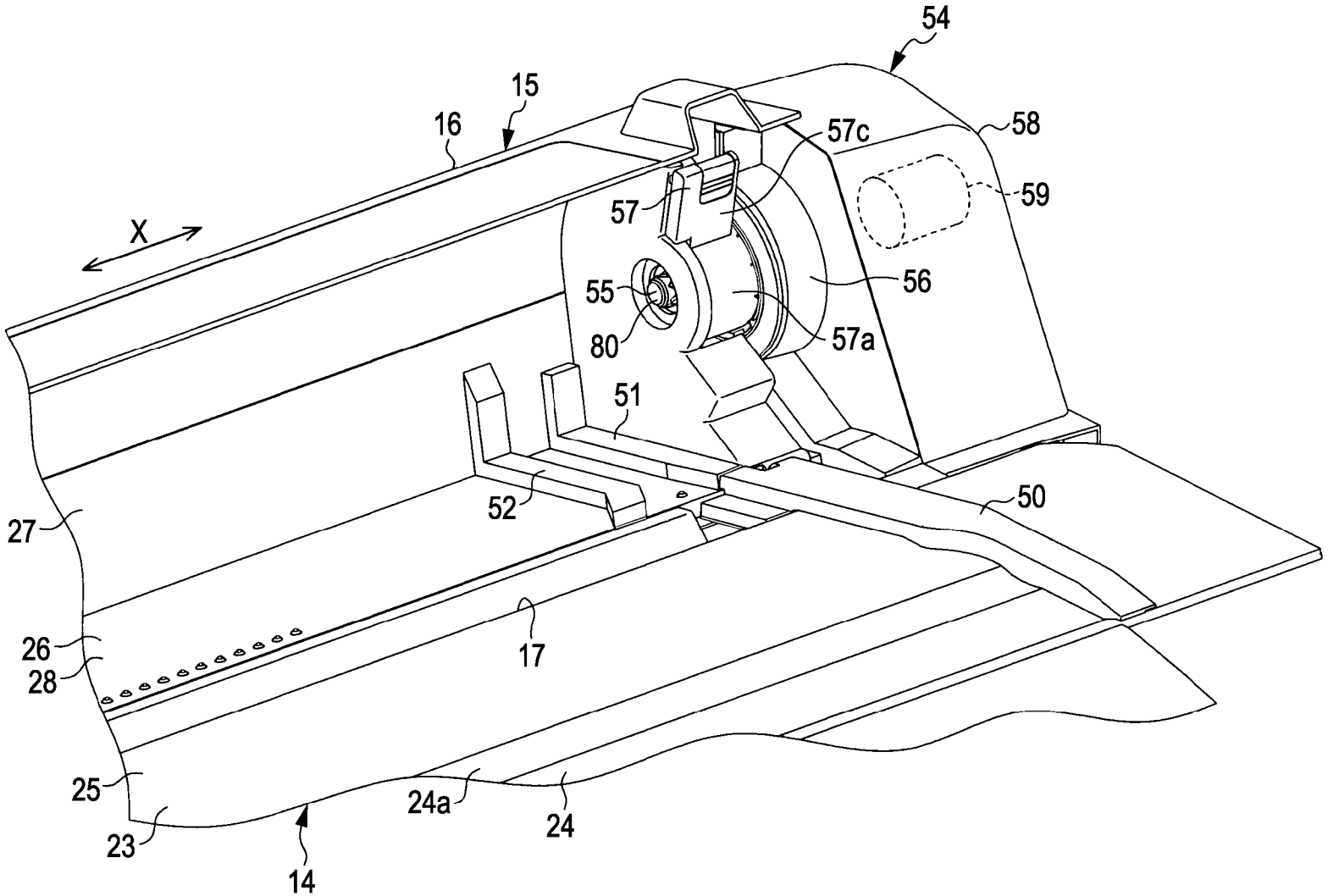
FIG. 6 is a primary part enlarged perspective view of FIG. 2.

As illustrated in FIG. 6, a first guide member 50 is provided on one end portion (right end portion in FIG. 6) on the top plate 23 of the main body 14 in the scanning direction X. The first guide member 50 extends in the direction (front-rear direction in FIG. 6) orthogonal to the scanning direction X. Further, a second guide member 51 is provided on one end portion (right end portion in FIG. 6) on the bottom plate 26 of the loading unit 15 in the scanning direction X. The second guide member 51 extends in the direction (front-rear direction in FIG. 6) orthogonal to the scanning direction X.

One end side (front end side in FIG. 6) of the second guide member 51 makes contact with the first guide member 50 and the other side (rear end side in FIG. 6) thereof is bent upward perpendicularly and extends along the rear-side plate 27. In this case, the second guide member 51 makes contact with the first guide member 50 such that corresponding surfaces thereof are substantially flushed with each other. In addition, the front end of the bent portion of the second guide member 51 reaches approximately half the height of the rear-side plate 27.

Further, a third guide member 52 that extends to be parallel with the second guide member 51 is provided on the bottom plate 26. An end portion of the third guide member 52 at the side opposite to the top plate 23 is bent upward perpendicularly and extends along the rear-side plate 27 in the same manner as the second guide member 51. In this case, a space between the second guide member 51 and the third guide member 52 is set to be slightly wider than the thickness of the flange member 32 (see FIG. 4).

Accordingly, when the roll paper RP (see FIG. 3) to which the supporting units 30 are attached is loaded on the loading unit 15, the flange member 32 of the supporting unit 30 can be inserted into between the second guide member 51 and the third guide member 52. It is to be noted that the end portion of the third guide member 52 at the side of the top plate 23 is bent to the side opposite to the second guide member 51 at an angle of approximately 30 degrees in order to make the flange member 32 be inserted into between the second guide member 51 and the third guide member 52 easily from the side of the top plate 23.

A rotational force application unit 54 is provided on the loading unit 15 at a position (right end portion of the loading unit 15 in FIG. 6) that is opposed to the third guide member 52 with the second guide member 51 interposed therebetween. The rotational force application unit 54 applies a rotational force to the roll paper RP through the shaft rotating member 31 (see FIG. 3) when the roll paper RP (see FIG. 3) to which the supporting units 30 are attached is placed on the placement portion 28.

The rotational force application unit 54 includes a rotational force transfer unit 55, a shaft cover 56, an operation portion 57, and a motor 59 as a rotation driving portion. The rotational force transfer unit 55 is movable along the scanning direction X so as to push out or pull in with respect to the placement portion 28. The shaft cover 56 covers the rotational force transfer unit 55. The operation portion 57 is a portion for operating such that the rotational force transfer unit 55 is operated to push out or pull in with respect to the placement portion 28. The motor 59 is arranged in a case 58 and rotationally drives the rotational force transfer unit 55.

Figure 7:
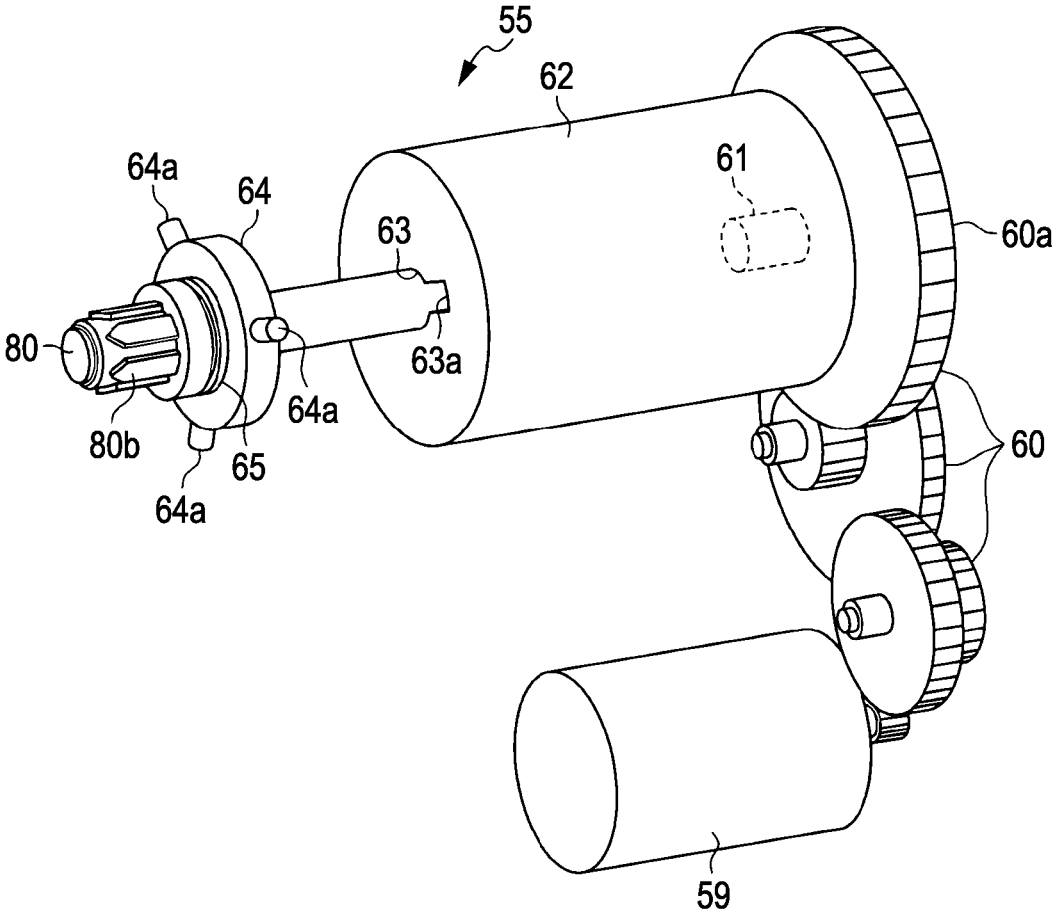
FIG. 7 is a perspective view illustrating a connection state from a motor to a second shaft member.

As illustrated in FIG. 7, the rotational force transfer unit 55 includes a columnar first shaft member 61, a columnar rotation supporting member 62 as a rotating member, and a columnar second shaft member 80. A rotational force of the motor 59 is transferred to the first shaft member 61 through a gear train 60 formed by a plurality of gears. The rotation supporting member 62 is supported by the first shaft member 61 in an integrally rotatable manner. The second shaft member 80 is supported by the rotation supporting member 62 in an integrally rotatable manner.

That is to say, the first shaft member 61 and the second shaft member 80 are arranged so as to be opposed to each other in the axial line direction of the rotation supporting member 62 with the rotation supporting member 62 interposed therebetween. The outer diameter of the rotation supporting member 62 is larger than the outer diameter of the first shaft member 61 and the outer diameter of the second shaft member 80.

Figure 8:
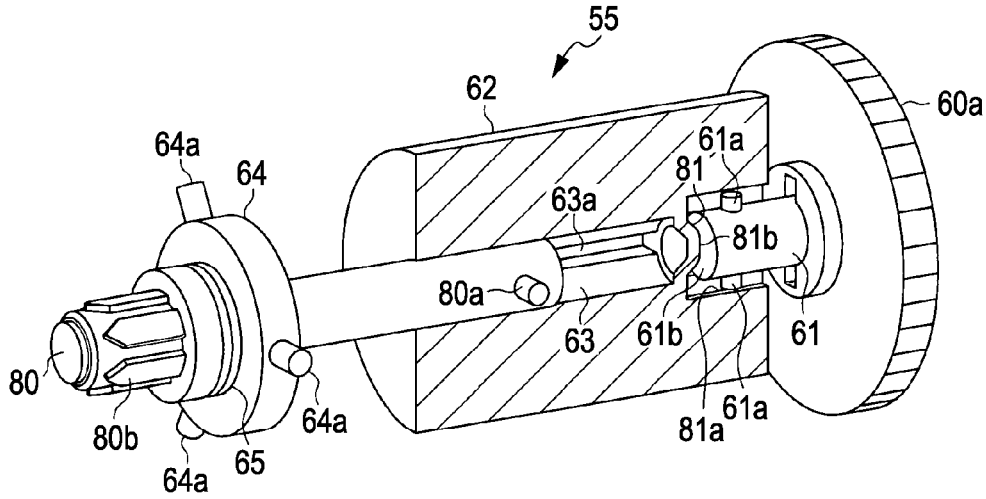
FIG. 8 is a cross-sectional perspective view illustrating a rotational force transfer unit.
Figure 9:
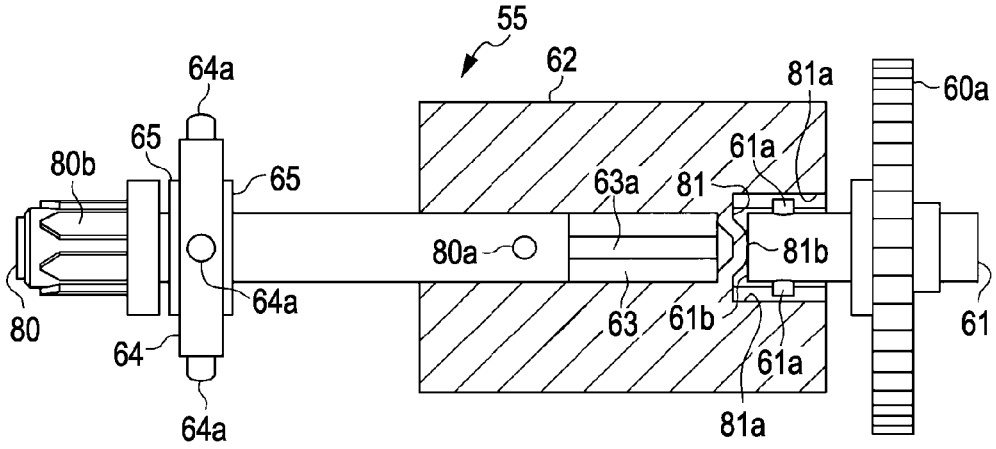
FIG. 9 is a side cross-sectional view illustrating the rotational force transfer unit.

As illustrated in FIG. 8 and FIG. 9, the first shaft member 61 is coupled to the center of a transfer gear 60*a* so as to be rotatable with the transfer gear 60*a*. The transfer gear 60*a* is arranged at a position that is the farthest from the motor 59 among the gears constituting the gear train 60. In this case, the rotational axial line of the first shaft member 61 and the rotational axial line of the transfer gear 60*a* are identical.

A circular movably inserting concave portion 81 is formed on a center portion of the surface of the rotation supporting member 62 at the side opposite to the side of the second shaft member 80. The front end portion of the first shaft member 61 is movably inserted into the movably inserting concave portion 81. First square grooves 81*a* are formed on the rotation supporting member 62 at both sides opposed to each other with the movably inserting concave portion 81 interposed therebetween in the radial direction so as to form a pair. The first square grooves 81*a* communicate with the movably inserting concave portion 81 and extend in the depth direction of the movably inserting concave portion 81. The length of the first square grooves 81*a* is the same as the depth of the movably inserting concave portion 81. A center portion of the bottom surface of the movably inserting concave portion 81 is formed as a raised portion 81*b* raised in a substantially conic form.

First protrusions 61*a* are formed on a front end portion of the first shaft member 61. The first protrusions 61*a* are inserted into the respective first square grooves 81*a* when the front end portion of the first shaft member 61 is movably inserted into the movably inserting concave portion 81. The projecting length of each first protrusion 61*a* is set to be slightly smaller than the depth of each first square groove 81*a*. The front end surface of the first shaft member 61 is formed as a flat engagement surface 61*b* that is engaged with the raised portion 81*b* when the front end portion of the first shaft member 61 is movably inserted into the movably inserting concave portion 81.

Accordingly, the direction of the rotational axial line of the rotation supporting member 62 is variable in a state where the raised portion 81*b* of the movably inserting concave portion 81 makes contact with (abuts against) the engagement surface 61*b*. That is to say, the rotation supporting member 62 is supported by the first shaft member 61 in a state where an angle formed between the rotational axial line thereof and the rotational axial line of the first shaft member 61 is variable. In other words, the rotation supporting member 62 is connected to the first shaft member 61 so as to be inclined movably in all of the radial directions about the raised portion 81*b*.

A circular insertion hole 63 is formed on a center portion of the surface of the rotation supporting member 62 at the side opposite to the side of the first shaft member 61 so as to extend in the axial line direction of the rotation supporting member 62. The base end of the second shaft member 80 is inserted into the insertion hole 63 so as to be movable in a sliding manner. In this case, the insertion hole 63 does not reach the movably inserting concave portion 81.

Second square grooves 63*a* are formed on the rotation supporting member 62 at both sides opposed to each other with the insertion hole 63 interposed therebetween so as to form a pair. The second square grooves 63*a* communicate with the insertion hole 63 and extend in parallel with the insertion hole 63. Second protrusions 80*a* are formed on a base end portion of the second shaft member 80. The second protrusions 80*a* are inserted into the respective second square grooves 63*a* so as to be movable in a sliding manner when the base end portion of the second shaft member 80 is inserted into the insertion hole 63.

Accordingly, if the base end portion of the second shaft member 80 is inserted into the insertion hole 63, the rotation supporting member 62 supports the second shaft member 80 so as to allow it to move in the axial line direction (scanning direction X) thereof in a sliding manner and restrict it from moving in the radial direction.

A plurality of engagement ribs 80*b* are provided on the circumferential surface of the front end portion of the second shaft member 80 at a constant interval in the circumferential direction. The front end portion of the second shaft member 80 can be inserted into the shaft hole 38 (see FIG. 5) of the shaft rotating member 31 of the supporting unit 30. When the front end portion of the second shaft member 80 is inserted into (engaged with) the shaft hole 38, the engagement ribs 80*b* and the engaging pieces 39 (see FIG. 5) are engaged with each other in the circumferential direction.

In this case, the front end portion of the second shaft member 80 can be inserted into the shaft hole 38 (see FIG. 5) of the shaft rotating member 31 of the supporting unit 30 even obliquely. Even when the end portion of the second shaft member 80 is inserted thereinto obliquely, the engagement ribs 80*b* and the engaging pieces 39 (see FIG. 5) are engaged with each other in the circumferential direction. That is to say, the second shaft member 80 can be inserted into (engaged with) the shaft hole 38 (see FIG. 5) of the shaft rotating member 31 of the supporting unit 30 in a state where the direction of the rotational axial line thereof is variable.

Further, as illustrated in FIG. 7, if the motor 59 is driven in a state where the front end portion of the second shaft member 80 is inserted into the shaft hole 38 (see FIG. 5) of the shaft rotating member 31, the rotational force thereof is transferred to the shaft rotating member 31 through the gear train 60, the first shaft member 61, the rotation supporting member 62, and the second shaft member 80.

As illustrated in FIG. 9, a circular ring-like ring member 64 is provided on the second shaft member 80 at a position slightly closer to the base end thereof relative to the front end portion in a rotatable manner. E rings 65 are provided on the second shaft member 80 at both sides of the ring member 64 in the axial line direction. The E rings 65 restrict the ring member 64 from moving in the axial line direction. Three protrusions 64*a* are provided on the circumferential surface of the ring member 64 at a constant interval in the circumferential direction. The three protrusions 64*a* project in the radial direction.

Figure 10:
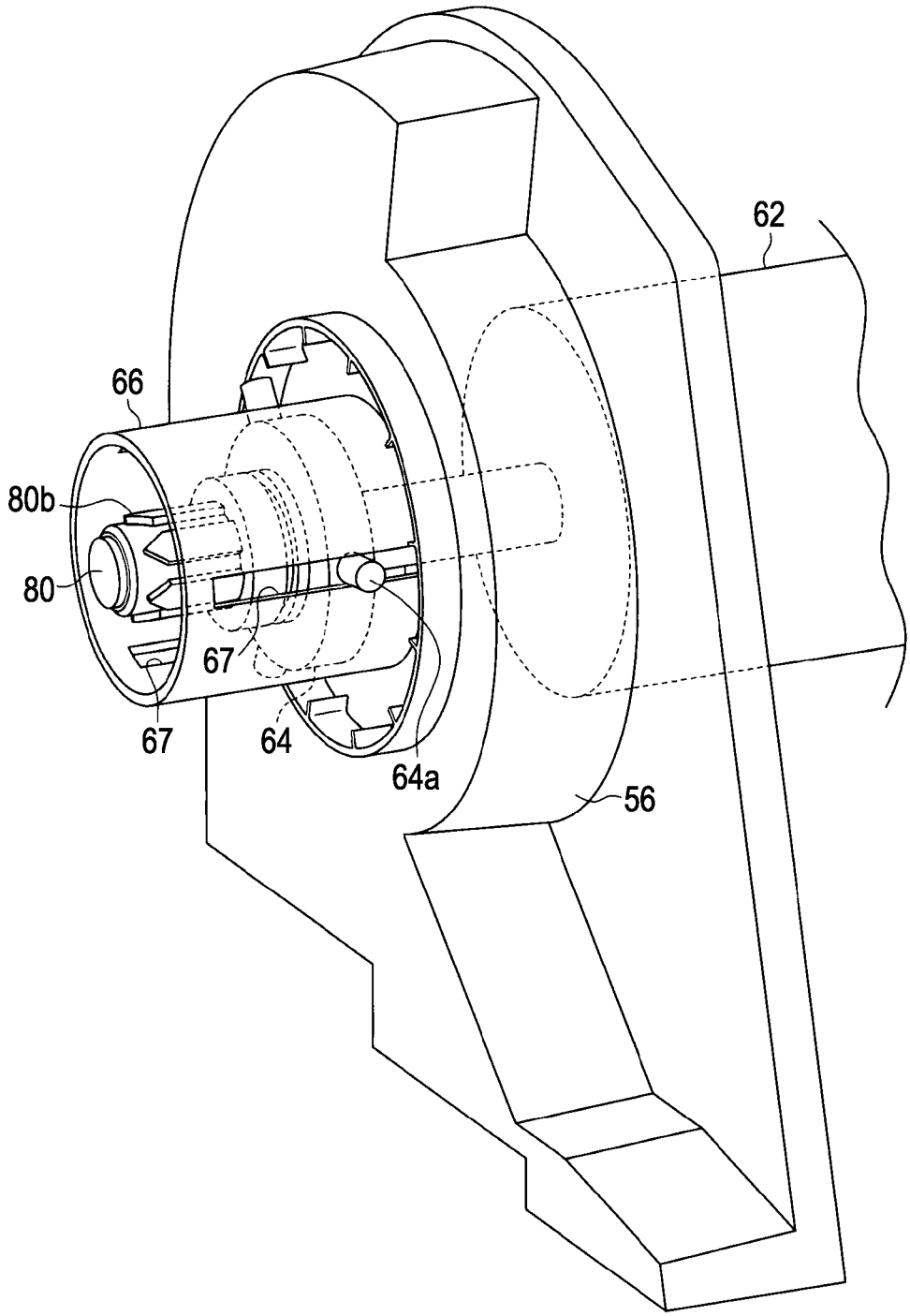
FIG. 10 is an enlarged perspective view illustrating a state where a shaft cover covers a rotating shaft.

As illustrated in FIG. 10, the shaft cover 56 includes a cylindrical accommodating portion 66 that accommodates the second shaft member 80 in a center portion thereof. Three through-holes 67 having rectangular shapes are formed on the circumferential wall of the accommodating portion 66 at a constant interval in the circumferential direction. The three through-holes 67 extend in the axial line direction. The respective protrusions 64*a* of the ring member 64 are inserted into the respective through-holes 67 so as to be movable in a sliding manner.

Figure 11:
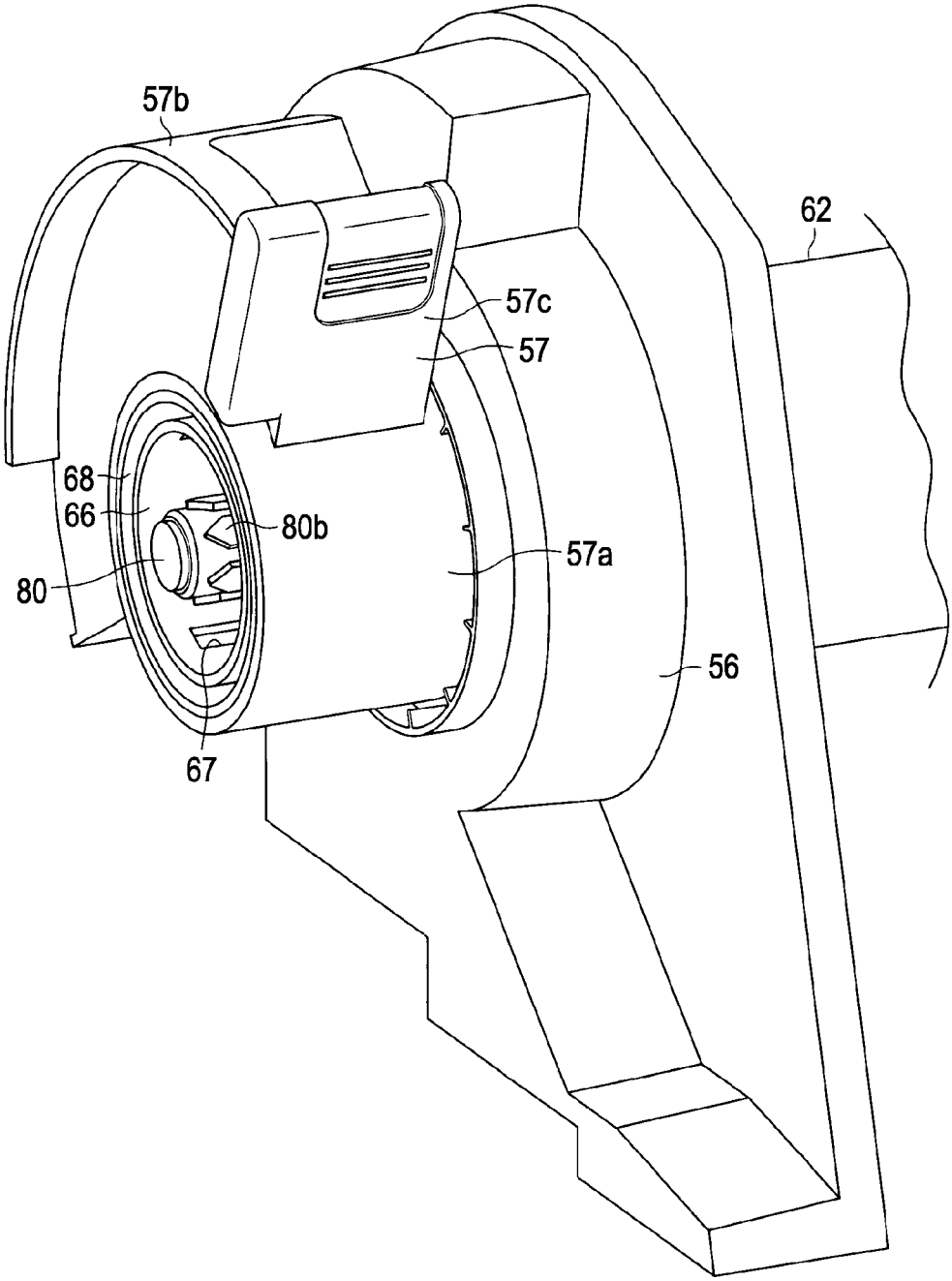
FIG. 11 is a perspective view illustrating a state where an operation portion is assembled on the shaft cover in FIG. 10.

As illustrated in FIG. 11, the operation portion 57 includes a cylindrical rotational shaft portion 57*a*, a substantially semicircular ring-like shielding portion 57*b*, and a substantially rectangular plate-like operation lever 57*c*. The shielding portion 57*b* is formed on the circumferential surface of the rotational shaft portion 57*a*. The operation lever 57*c* is formed on the circumferential surface of the rotational shaft portion 57*a* so as to be adjacent to the shielding portion 57*b*. The operation portion 57 is assembled on the shaft cover 56 in a rotationally movable manner such that the accommodating portion 66 is accommodated in the rotational shaft portion 57*a*.

Figure 12:
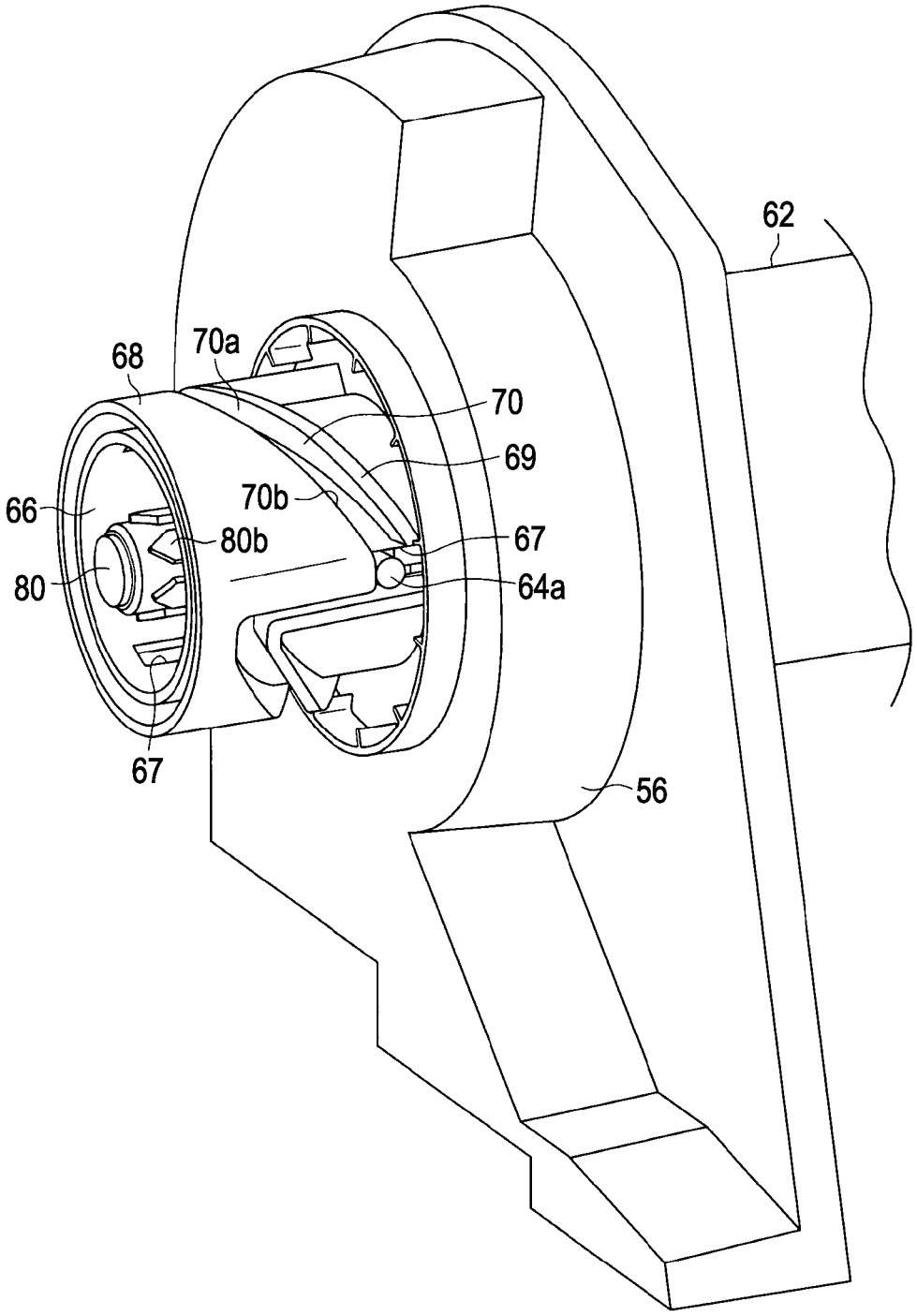
FIG. 12 is a perspective view illustrating a cam groove formed by a cam groove formation member and a cam groove formation wall.

As illustrated in FIG. 11 and FIG. 12, a cam groove formation member 68 is assembled on the inner circumferential surface of the rotational shaft portion 57*a* so as to be integrally rotatable with the rotational shaft portion 57*a*. The cam groove formation member 68 is formed to have a substantially cylindrical shape of which inner diameter is larger than the outer diameter of the accommodating portion 66 and outer diameter is smaller than the inner diameter of the rotational shaft portion 57*a*. Further, a cam groove formation wall 69 is provided on the inner circumferential surface of the rotational shaft portion 57*a* so as to be opposed to the cam groove formation member 68 in the axial line direction.

In this case, the cam groove formation member 68 is located at the front end side of the accommodating portion 66 relative to the cam groove formation wall 69. Further, three cam grooves 70 are formed by the cam groove formation member 68 and the cam groove formation wall 69 at a constant interval in the circumferential direction of the rotational shaft portion 57*a*. The surfaces of the cam grooves 70 at the side of the cam groove formation wall 69 are formed as first cam surfaces 70*a* and the surfaces thereof at the side of the cam groove formation member 68 are formed as second cam surfaces 70*b*.

The front end portions of the respective protrusions 64*a* of the ring member 64 are inserted in the respective cam grooves 70 in a slidable manner. Each cam groove 70 extends from the position corresponding to the base end portion of the accommodating portion 66 to the position corresponding to the front end portion of the accommodating portion 66 along the circumferential surface of the accommodating portion 66. The cam groove 70 extends obliquely with respect to the circumferential direction of the accommodating portion 66.

As illustrated in FIG. 6 and FIG. 12, in a state where the operation lever 57*c* of the operation portion 57 is located at the upper side relative to the second shaft member 80, the front end portion of the second shaft member 80 is accommodated in the accommodating portion 66 and the respective protrusions 64*a* of the ring member 64 are located at the end portions of the respective through-holes 67 of the accommodating portion 66 at the side of the motor 59.

The position of the second shaft member 80 at that time is located at a non-transfer position (position as illustrated in FIG. 6 and FIG. 10). At the non-transfer position, the rotational force of the motor 59 is not transferred to the roll paper RP through the shaft rotating member 31 of the supporting unit 30 when the roll paper RP (see FIG. 3) to which the supporting units 30 are attached is placed on the placement portion 28. In this case, the second shaft member 80 is distanced from the shaft rotating member 31 at the non-transfer position.

Figure 13:
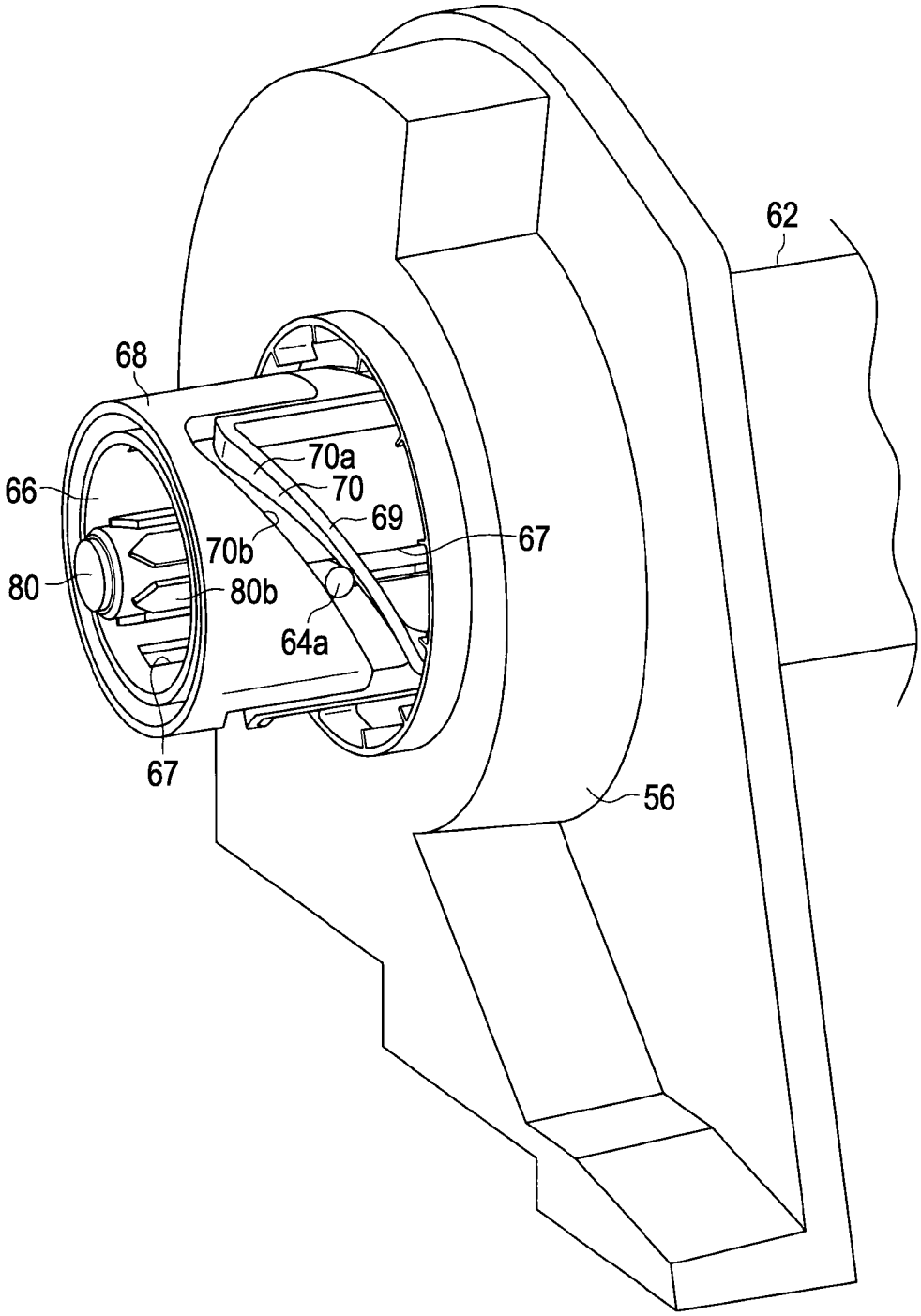
FIG. 13 is a perspective view illustrating a state where a protrusion of a ring member is moved in the cam groove in a sliding manner.
Figure 15:
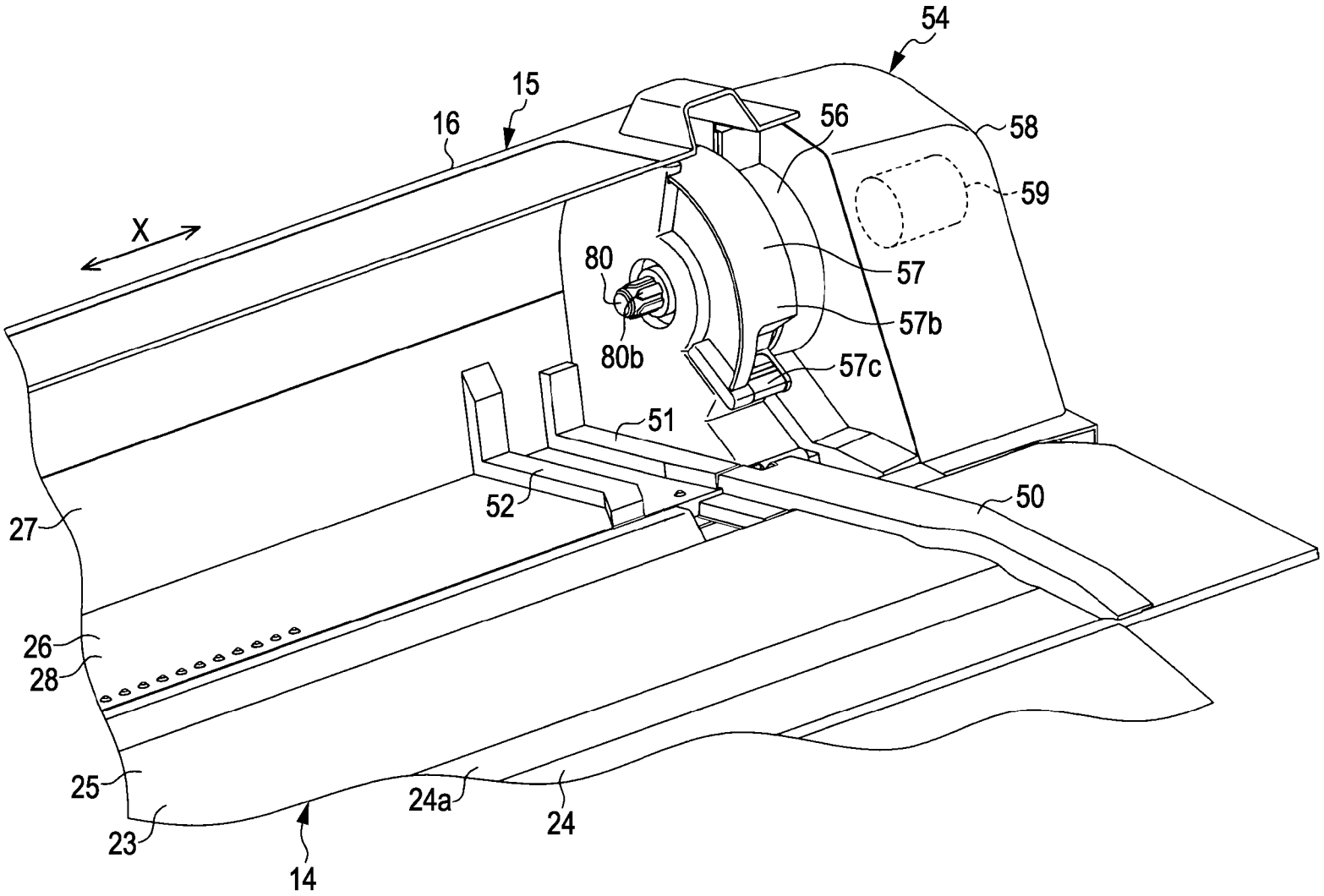
FIG. 15 is a primary part enlarged perspective view illustrating a state where an operation lever is lowered in FIG. 6.

Then, if the operation lever 57*c* of the operation portion 57 is operated from this state such that the operation lever 57*c* is moved (rotationally moved) toward the position at the lower side relative to the second shaft member 80 as illustrated in FIG. 15, the operation lever 57*c* is moved while the respective first cam surfaces 70*a* make contact with the respective protrusions 64*a* of the ring member 64 in the sliding manner, as illustrated in FIG. 13. With this, as illustrated in FIG. 13 and FIG. 15, the respective protrusions 64*a* of the ring member 64 are pressurized to the side of the placement portion 28 with the respective first cam surfaces 70*a* so as to move toward the end portions of the respective through-holes 67 of the accommodating portion 66 at the side of the placement portion 28 in the respective through-holes 67 in the sliding manner.

The second shaft member 80 is moved to the side of the placement portion 28 along the axial line direction thereof with the sliding movement of the respective protrusions 64*a* of the ring member 64. Then, as illustrated in FIG. 14 and FIG. 15, in a state where the operation lever 57*c* of the operation portion 57 is moved to the position at the lower side relative to the second shaft member 80, the front end portion of the second shaft member 80 projects to the outer side of the accommodating portion 66 and the protrusions 64*a* of the ring member 64 are located at the end portions of the respective through-holes 67 of the accommodating portion 66 at the side of the placement portion 28.

Figure 14:
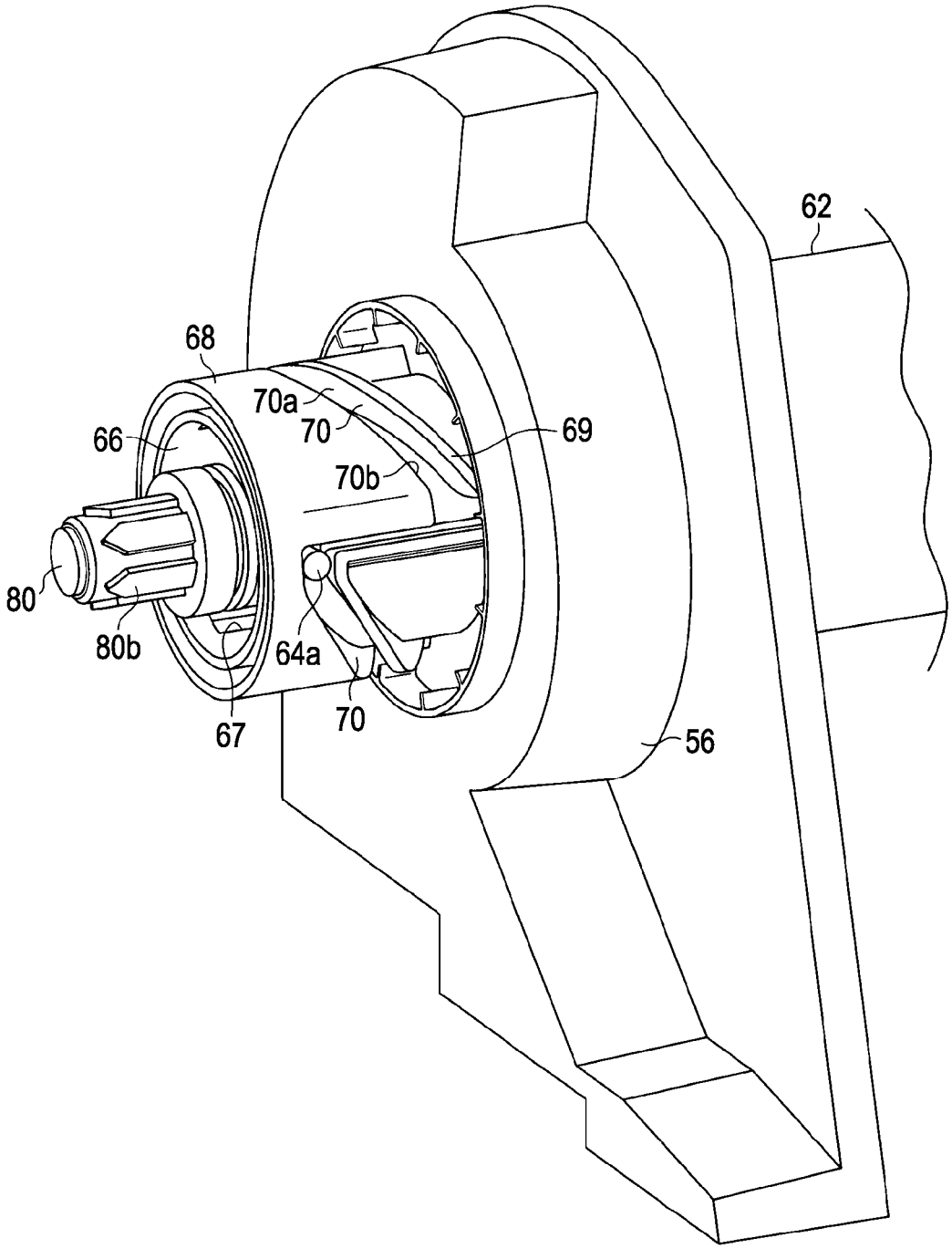
FIG. 14 is a perspective view illustrating a positional relationship between the cam groove and the protrusion of the ring member when a second shaft member is located at a transfer position.

When the roll paper RP (see FIG. 3) to which the supporting units 30 are attached is placed on the placement portion 28, the position of the second shaft member 80 at this time corresponds to the transfer position (position as illustrated in FIG. 14 and FIG. 15) at which the rotational force of the motor 59 is transferred to the roll paper RP through the shaft rotating member 31 of the supporting unit 30. In this case, the second shaft member 80 is engaged with the shaft rotating member 31 at the transfer position.

Further, when the second shaft member 80 is moved to the non-transfer position from the transfer position, as illustrated in FIG. 6, the operation lever 57*c* of the operation portion 57 is operated so as to be moved (rotationally moved) to the position at the upper side relative to the second shaft member 80. With the operation, the operation lever 57*c* is moved while the respective second cam surfaces 70*b* make contact with the respective protrusions 64*a* of the ring member 64 in the sliding manner, as illustrated in FIG. 13.

With this, as illustrated in FIG. 13 and FIG. 6, the protrusions 64*a* of the ring member 64 are pressurized to the side of the motor 59 with the respective second cam surfaces 70*b* so as to move toward the end portions of the respective through-holes 67 of the accommodating portion 66 at the side of the motor 59 in the respective through-holes 67. The second shaft member 80 is moved to the side of the motor 59 along the axial line direction thereof with the sliding movement of the respective protrusions 64*a* of the ring member 64.

Then, as illustrated in FIG. 6 and FIG. 12, in a state where the operation lever 57*c* of the operation portion 57 is moved to the position at the upper side relative to the second shaft member 80, the front end portion of the second shaft member 80 is accommodated in the accommodating portion 66 and the respective protrusions 64*a* of the ring member 64 are located at the end portions of the respective through-holes 67 of the accommodating portion 66 at the side of the motor 59. In this manner, the second shaft member 80 is moved from the transfer position to the non-transfer position.

Accordingly, if the operation portion 57 is operated, the second shaft member 80 is moved between the transfer position and the non-transfer position. In the embodiment, the medium loading apparatus is constituted by the loading unit 15, the supporting unit 30, the first shaft member 61, the second shaft member 80, and the rotation supporting member 62.

Next, actions of the ink jet printer 11 are described.

Figure 16:
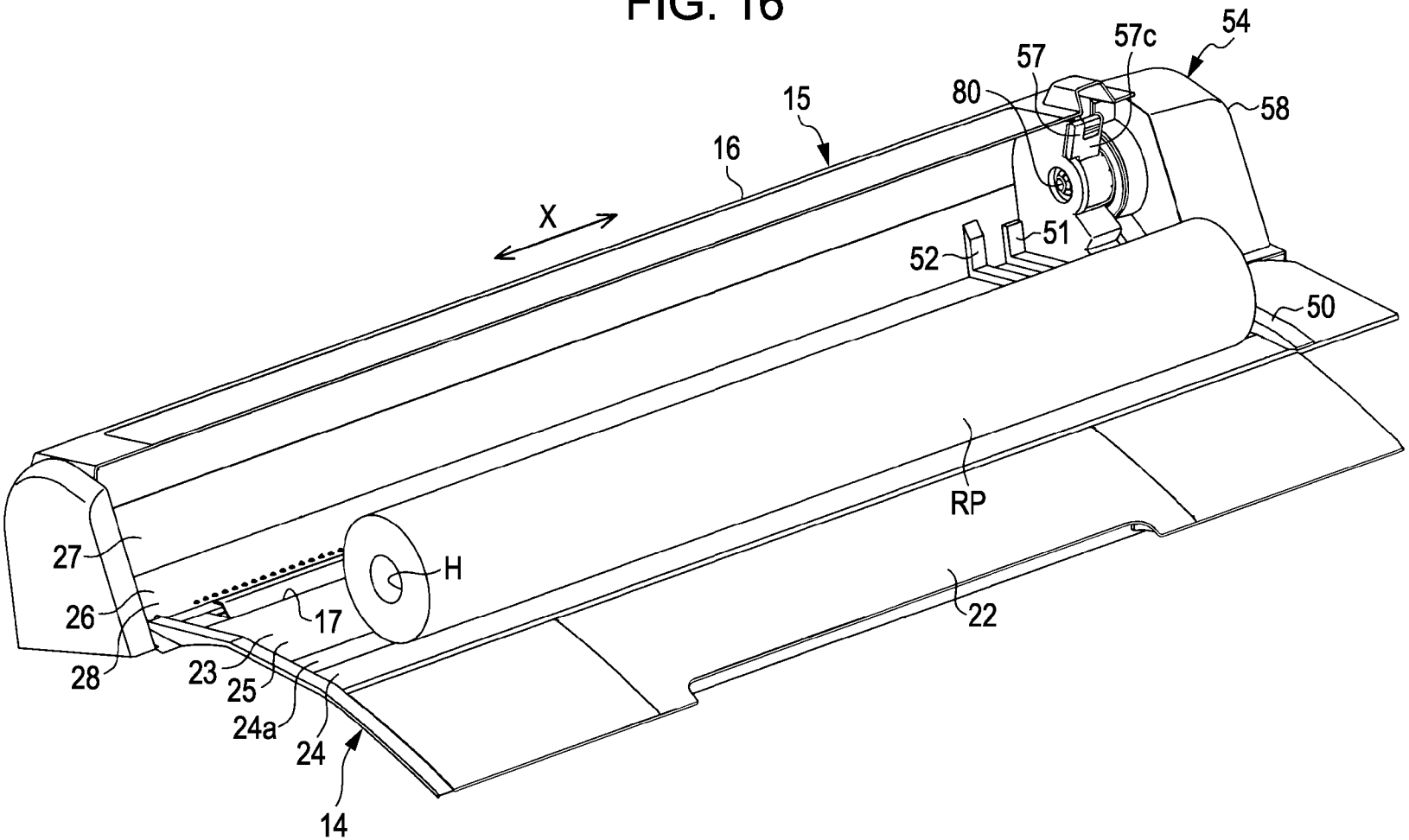
FIG. 16 is a perspective view illustrating a state where roll paper is placed on a temporal placement portion FIG. 2.

When printing on the roll paper RP is performed, the opening/closing cover 16 is opened and the operation lever 57*c* is moved to the upper side first so as to locate the second shaft member 80 at the non-transfer position. In this state, as illustrated in FIG. 16, a user places the roll paper RP on the positioning concave portion 24*a* of the temporal placement portion 24. Then, the roll paper RP is stable on the positioning concave portion 24*a*, so that rolling of the roll paper RP is suppressed.

Figure 17:
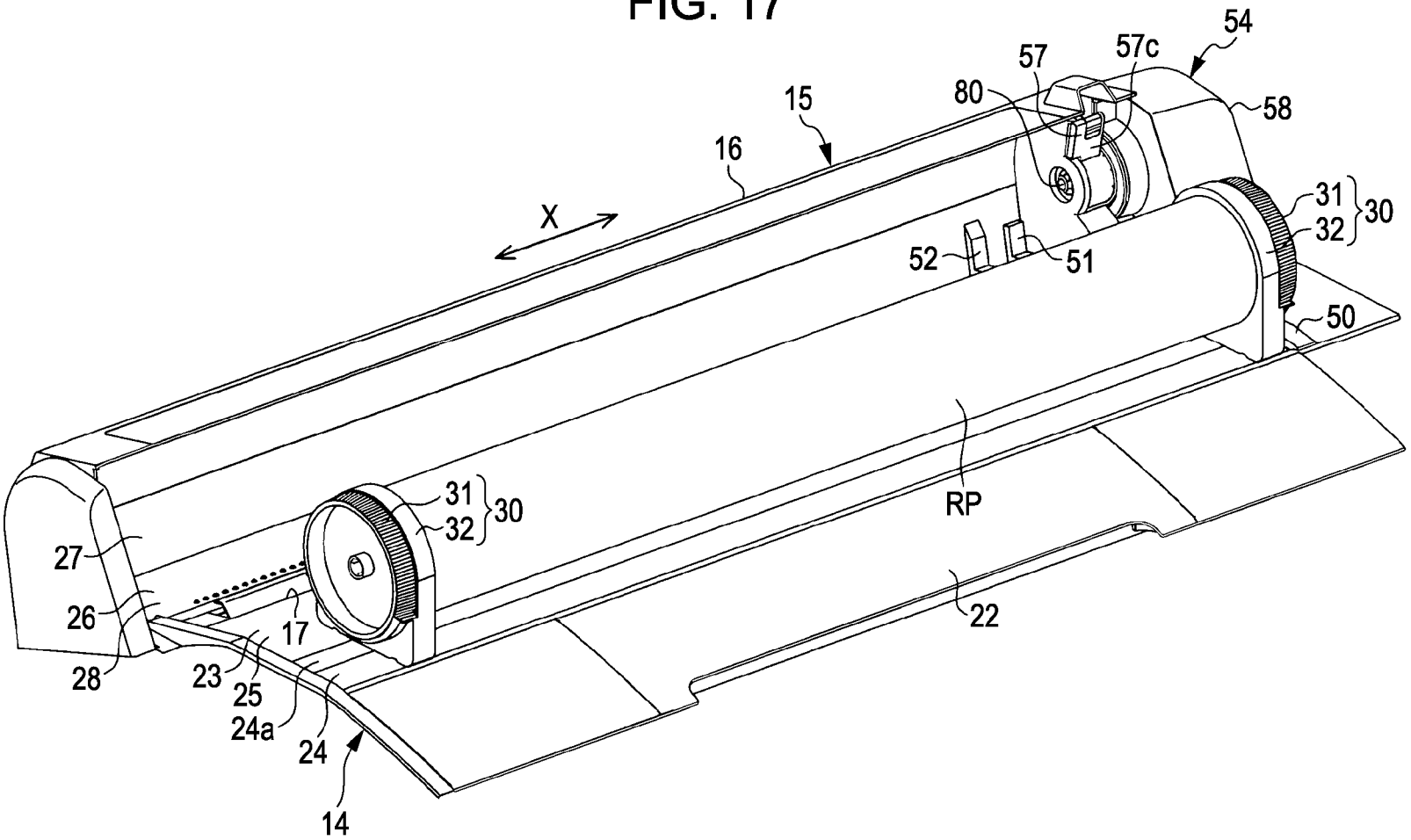
FIG. 17 is a perspective view illustrating a state where the supporting units are attached to the roll paper in FIG. 16.

Subsequently, as illustrated in FIG. 17, the user causes the shaft portions 37 (see FIG. 4) of the shaft rotating members 31 of the respective supporting units 30 to be fitted into the center hole H (see FIG. 16) from both sides of the roll paper RP, so that the supporting units 30 are attached to both end portions of the roll paper RP. Then, in a state where the supporting units 30 are respectively attached to both end portions of the roll paper RP, the roll paper RP is supported by the supporting units 30 in a state of coming off the temporal placement portion 24.

Then, the user pressurizes the roll paper RP to which the supporting units 30 are attached to both end portions, that is, the supporting units 30 supporting the roll paper RP toward the placement portion 28 from the temporal placement portion 24.

With this, the supporting units 30 supporting the roll paper RP are moved on the top plate 23 in the sliding manner. That is to say, the supporting units 30 supporting the roll paper RP are lowered toward the placement portion 28 on the inclined portion 25 in the sliding manner while the roll paper RP does not rotate. In this case, the supporting unit 30 at the side of the first guide member 50 is introduced to between the second guide member 51 and the third guide member 52 on the placement portion 28 while being guided by the first guide member 50.

Figure 18:
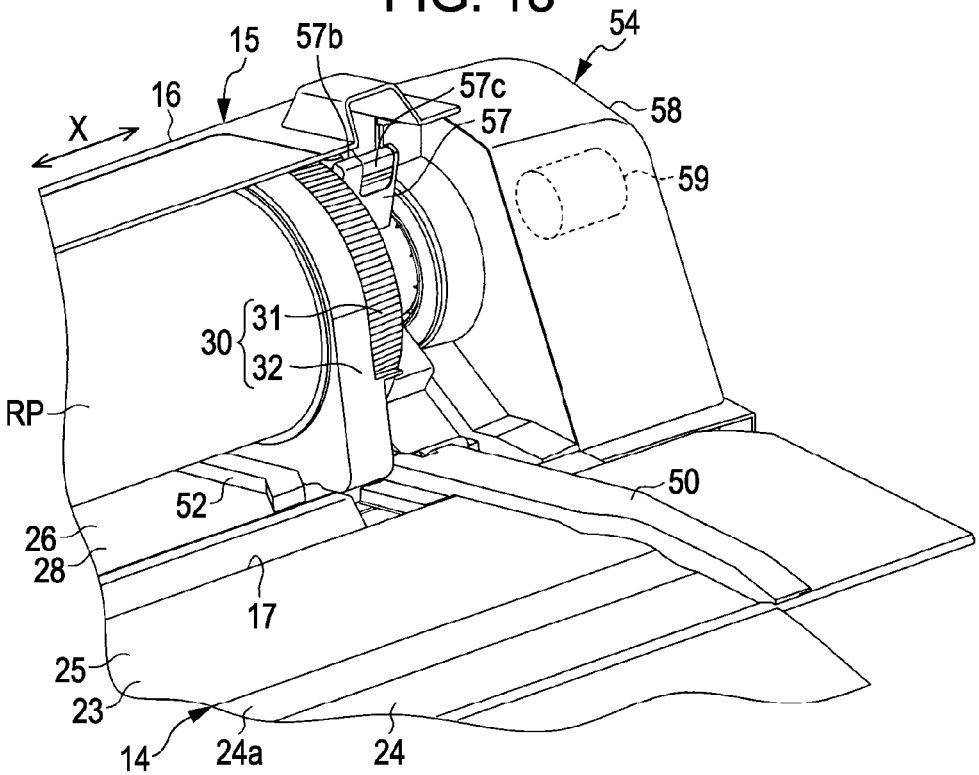
FIG. 18 is a perspective view illustrating a state when the roll paper to which the supporting units are attached is loaded on the loading unit in FIG. 6.

Subsequently, if the user further pressurizes the supporting units 30 to the side of the placement portion 28, as illustrated in FIG. 18, the roll paper RP is placed on the placement portion 28 in a state of being supported by the supporting units 30.

In this case, the supporting unit 30 at the side of the first guide member 50 is inserted into between the second guide member 51 and the third guide member 52 on the placement portion 28 while being guided by the second guide member 51 (see FIG. 17) and the third guide member 52. Therefore, the supporting unit 30 at the side of the first guide member 50 is positioned in the scanning direction X by the second guide member 51 and the third guide member 52, and eventually, the roll paper RP is positioned in the scanning direction X.

Further, in a state where the roll paper RP to which the supporting units 30 are attached is placed on the placement portion 28, the shaft hole 38 of the shaft rotating member 31 on the supporting unit 30 at the side of the first guide member 50 and the second shaft member 80 are opposed to each other in the scanning direction X. That is to say, the rotational axial line of the second shaft member 80 and the rotational axial line of the roll paper RP (shaft rotating member 31) are identical.

Figure 19:
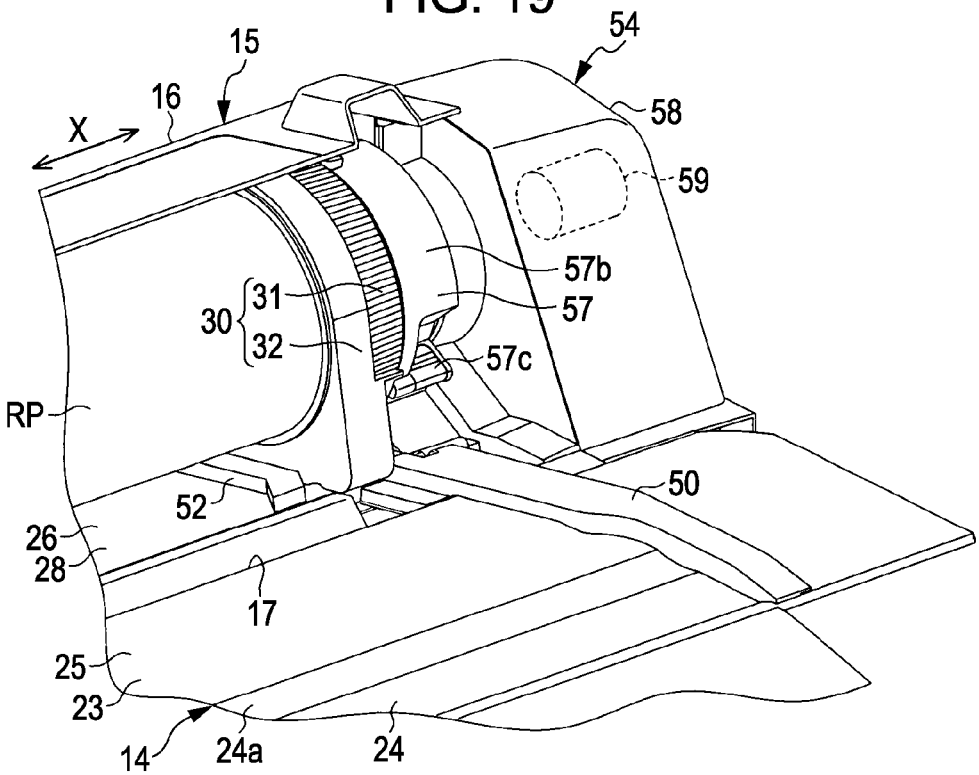
FIG. 19 is a perspective view illustrating a state where the operation lever is lowered in FIG. 18.

Subsequently, the operation lever 57*c* is moved to the lower side in a state where the roll paper RP to which the supporting units 30 are attached is placed on the placement portion 28, as illustrated in FIG. 19. With this, the second shaft member 80 is moved to the transfer position so as to be inserted into the shaft hole 38 of the shaft rotating member 31 on the supporting unit 30 at the side of the first guide member 50 straightly.

In the state where the roll paper RP to which the supporting units 30 are attached is placed on the placement portion 28, the position of the shaft hole 38 of the shaft rotating member 31 on the supporting unit 30 at the side of the first guide member 50 and the position of the second shaft member 80 are deviated in the direction orthogonal to the scanning direction X in some cases. That is to say, the rotational axial line of the second shaft member 80 and the rotational axial line of the roll paper RP (shaft rotating member 31) are not identical in some cases.

Figure 20:
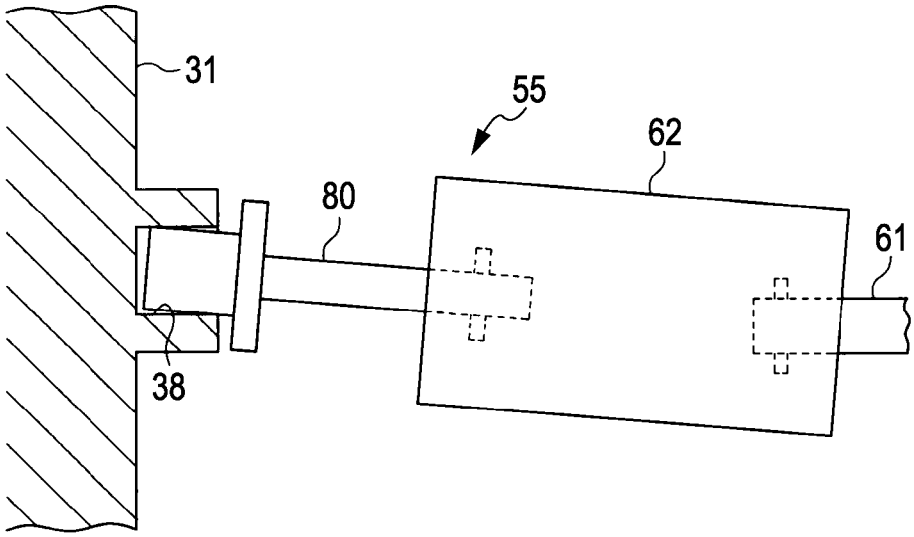
FIG. 20 is a view schematically illustrating a state where the second shaft member is inserted into a shaft hole of a shaft rotating member obliquely when the second shaft member is moved to the transfer position.

However, note that in the embodiment, a connection angle between the first shaft member 61 and the rotation supporting member 62 is variable. Therefore, even in the above-mentioned case, if the operation lever 57*c* is moved to the lower side as illustrated in FIG. 19, the second shaft member 80 is moved to the transfer position so as to be inserted into the shaft hole 38 of the shaft rotating member 31 on the supporting unit 30 at the side of the first guide member 50 obliquely, as illustrated in FIG. 20.

Deviation between the position of the shaft hole 38 of the shaft rotating member 31 and the position of the second shaft member 80 in the direction orthogonal to the scanning direction X is absorbed since the connection angle between the first shaft member 61 and the rotation supporting member 62 is variable. When the second shaft member 80 is inserted into the shaft hole 38 of the shaft rotating member 31 straightly or obliquely, the rotational axial line of the first shaft member 61 and the rotational axial line of the shaft rotating member 31 are parallel with each other all the time.

Figure 21:
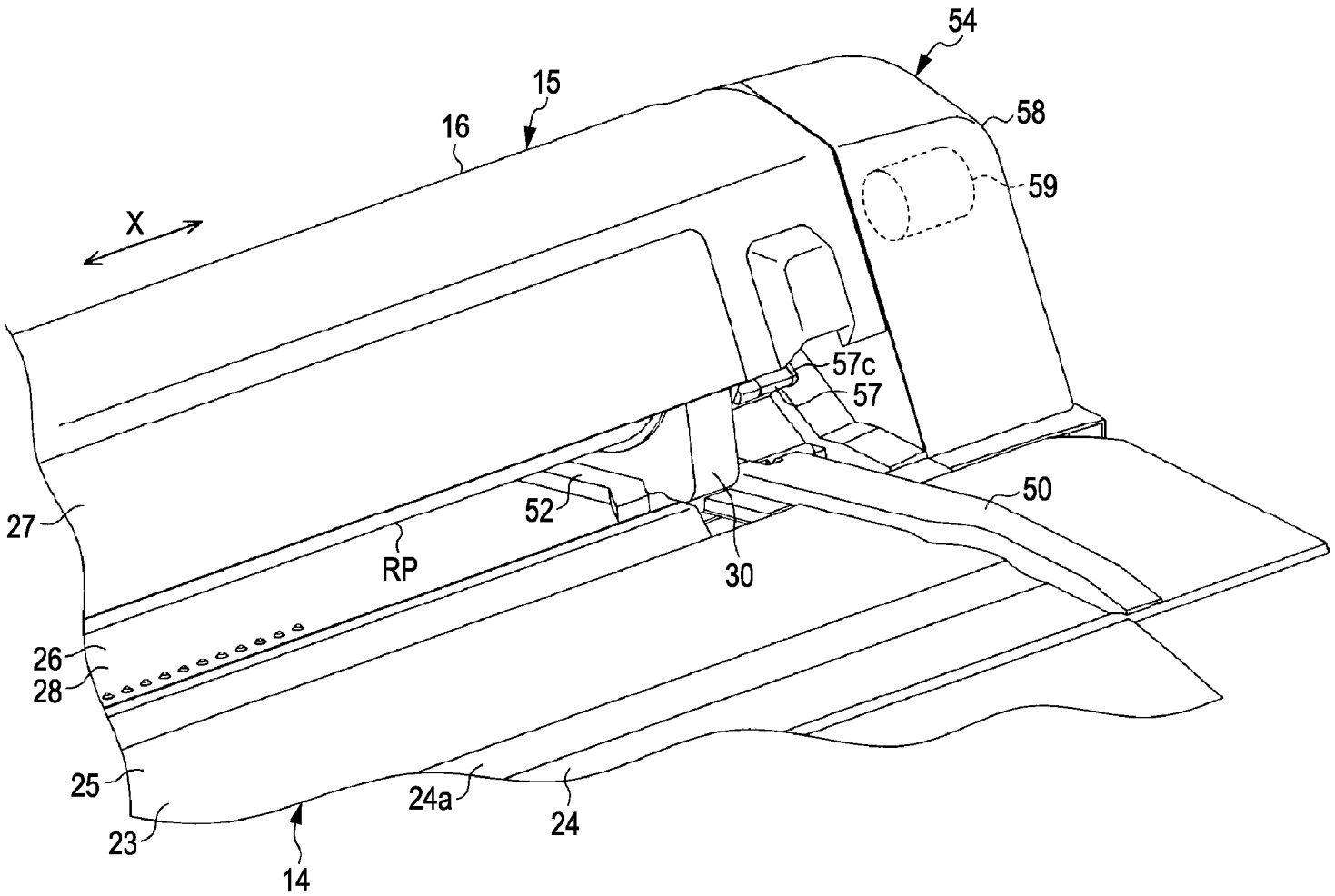
FIG. 21 is a perspective view illustrating a state where an opening/closing cover is closed in FIG. 19.

Subsequently, the paper P fed out while being unrolled from the roll paper RP loaded on the loading unit 15 is inserted into the main body 14 from the paper feeding port 17 along the transportation path thereof. Then, the opening/closing cover 16 is closed, as illustrated in FIG. 21. Thereafter, if the operation panel 21 is operated to start the printing operation, the gears constituting the gear train 60, the first shaft member 61, the rotation supporting member 62, and the second shaft member 80 are rotationally driven with the driving of the motor 59. With this, the rotational force of the motor 59 is transferred to the roll paper RP from the second shaft member 80 through the shaft rotating member 31.

Then, the respective shaft rotating members 31 and the roll paper RP rotate integrally in the direction in which the paper P is fed from the roll paper RP. Then, ink is ejected from the recording head 20 onto the paper P fed from the roll paper RP in a process in which the paper P is transported along the transportation path in the main body 14. With this, printing is performed. After that, the paper P is discharged from the paper discharge port 18.

The following effects can be obtained by the embodiment which has been described in detail.

1. The roll paper RP is loaded on the loading unit 15 in a state of being supported by the supporting units 30 at both sides and the second shaft member 80 is supported by the rotation supporting member 62 so as to be movable between the transfer position and the non-transfer position in the sliding manner. Then, the roll paper RP is loaded on the loading unit 15 in a state where the second shaft member 80 is moved to the non-transfer position. Thereafter, the second shaft member 80 is moved to the transfer position from the non-transfer position. Therefore, the length of the loading unit 15 can be made smaller than that in a configuration in which the roll paper RP is supported by inserting shafts thereinto from both sides. This makes it possible to reduce the loading unit 15 in size, and eventually, reduce the ink jet printer 11 in size.

2. The second shaft member 80 is inserted into the shaft hole 38 of the shaft rotating member 31 in a state where the rotational axial line is variable when the second shaft member 80 is located at the transfer position. Therefore, even when the position of the shaft hole 38 of the shaft rotating member 31 and the position of the second shaft member 80 are deviated in the radial direction, the deviation can be absorbed. Accordingly, the rotational force of the motor 59 can be transferred to the shaft rotating member 31 from the second shaft member 80 reliably.

3. The second shaft member 80 is supported by the rotation supporting member 62 so as to be restricted from moving in the radial direction and be movable between the transfer position and the non-transfer position in the sliding manner in the axial line direction. Therefore, the deviation of the second shaft member 80 with respect to the rotation supporting member 62 in the radial direction is eliminated, thereby suppressing the positional deviation of the second shaft member 80 with respect to the shaft hole 38 of the shaft rotating member 31 in the radial direction.

4. The rotation supporting member 62 is supported by the first shaft member 61 so as to be rotatable therewith in a state where the rotational axial line is variable. That is to say, the rotation supporting member 62 and the first shaft member 61 have a connection configuration like a universal joint. Accordingly, the deviation between the position of the shaft hole 38 of the shaft rotating member 31 and the position of the second shaft member 80 in the radial direction orthogonal to the scanning direction X can be absorbed since the connection angle (engagement angle) between the first shaft member 61 and the rotation supporting member 62 is variable.

Variations

It is to be noted that the above-mentioned embodiment may be changed as follows.

The second shaft member 80 is not necessarily required to be supported by the rotation supporting member 62 in a state of being restricted from moving in the radial direction. That is to say, looseness of the second shaft member 80 in the radial direction with respect to the rotation supporting member 62 may be allowed.

The second shaft member 80 is not necessarily required to be inserted into the shaft hole 38 of the shaft rotating member 31 in a state where the rotational axial line is variable when the second shaft member 80 is located at the transfer position.

A plastic film, fabric, foil, and the like may be used as the roll medium instead of the roll paper RP.

In the above-mentioned embodiment, the recording apparatus may be fluid ejecting apparatuses that eject and discharge other fluids (including liquids, liquid-like materials obtained by dispersing or mixing particles of a functional material in liquid, fluid-like materials such as gel, solids which can be flowed and ejected as fluids) than ink so as to perform recording. For example, the recording apparatus may be liquid-like material ejecting apparatuses that eject liquid-like materials containing electrode materials or colorants (pixel materials) to be used for manufacturing liquid crystal displays, electroluminescent (EL) displays, or surface emitting displays in a form of dispersion or solution so as to perform recording. Further, the recording apparatus may be fluid-like material ejecting apparatuses that eject fluid-like materials such as gel (physical gel). The invention can be applied to any one of the fluid ejecting apparatuses. It is to be noted that the terminology "fluid" in the specification does not encompass fluids containing gas only conceptually. The fluids include liquids (inorganic solvents, organic solvents, solution, liquid-like resins, and liquid-like metals (metal melt), for example), liquid-like materials, fluid-like materials, and the like.

Further, a technical spirit that can be grasped by the above-mentioned embodiment is described as follows.

A medium loading apparatus according to any one of appended items 1 to 3, wherein the rotational axial line of the first shaft member and the rotational axial line of the medium holding portion are parallel.

The entire disclosure of Japanese Patent Application No. 2012-97417, filed Apr. 23, 2012 is expressly incorporated by reference herein.

What is claimed is:

1. A medium loading apparatus comprising:

supporting units that have medium holding portions which are attached to both end portions of a roll medium obtained by winding and overlapping a long medium in a roll form in an integrally rotatable manner with the roll medium and medium supporting portions which support the medium holding portions in a rotatable manner;

a loading unit that is loaded with the roll medium to which the supporting units are attached, and a rotational force transfer unit that is arranged on the loading unit so as to be opposed to the medium holding portion in the axial line direction of the roll medium and transfers a rotational force of a rotation driving unit to the medium holding portion, wherein the rotational force transfer unit includes:

a first shaft member to which the rotational force of the rotation driving unit is transferred;

a rotating member that is supported by the first shaft member in an integrally rotatable manner in a state where a rotational axial line is variable, and a second shaft member that is supported by the rotating member in an integrally rotatable manner and is configured to be movable between a transfer position at which the second shaft member is engaged with the medium holding portion and transfers the rotational force and a non-transfer position at which the second shaft member is distanced from the medium holding portion and does not transfer the rotational force.

2. The medium loading apparatus according to claim 1, wherein the second shaft member is engaged with the medium holding portion in a state where a rotational axial line is variable when the second shaft member is located at the transfer position.

3. The medium loading apparatus according to claim 1, wherein the second shaft member is supported by the rotating member in a state of being restricted from moving in the radial direction and being movable between the transfer position and the non-transfer position in the axial line direction.

4. A recording apparatus comprising:

the medium loading apparatus according to claim 1, and a recording unit that performs recording processing on the roll medium to be fed from the medium loading apparatus.

5. A recording apparatus comprising:

the medium loading apparatus according to claim 2, and a recording unit that performs recording processing on the roll medium to be fed from the medium loading apparatus.

6. A recording apparatus comprising:

the medium loading apparatus according to claim 3, and a recording unit that performs recording processing on the roll medium to be fed from the medium loading apparatus.

* * * * *